United States Patent [19]

Lee et al.

[11] 4,315,387

[45] Feb. 16, 1982

[54] GROUND ANCHOR STAKE DEVICE

[76] Inventors: John W. Lee, 7805 W. 96th St., Zionsville, Ind. 46077; Benton Schrougham, 243 S. 25th St., Beech Grove, Ind. 46107

[21] Appl. No.: 131,209

[22] Filed: Mar. 17, 1980

[51] Int. Cl.[3] ..... E02D 5/74

[52] U.S. Cl. ..... 52/156; 52/162

[58] Field of Search ..... 52/155, 156, 158, 159, 52/162, 163; 135/15 PE; 119/121

[56] References Cited

U.S. PATENT DOCUMENTS

| | | | |
|---|---|---|---|
| 108,832 | 11/1870 | Ritchie | 135/15 PE |
| 210,283 | 11/1878 | Whittier | 52/162 |
| 1,676,197 | 7/1928 | Marrinan | 52/156 |
| 2,156,021 | 4/1939 | Little | 135/15 PE |
| 3,793,787 | 2/1974 | Shidaker | 52/163 |
| 4,144,843 | 3/1979 | Schrougham | 119/121 |

FOREIGN PATENT DOCUMENTS

| | | | |
|---|---|---|---|
| 823336 | 10/1951 | Fed. Rep. of Germany | 52/155 |
| 10173 | of 1909 | United Kingdom | 135/15 PE |

*Primary Examiner*—Price C. Faw, Jr.
*Assistant Examiner*—Henry E. Raduazo
*Attorney, Agent, or Firm*—Robert A. Spray

[57] ABSTRACT

A ground anchor stake device characterized by a novel combination of ground-penetrating angular spike means and ground-penetrating arcuate tine means. The spike means and the tine means are movably interconnected in such manner that the spike means may be first pushed into the ground at an acute angle to the ground surface, and the arcuate tine means then pushed into the ground in a circular arcuate path to the ground surface. The ends of the spike means and the ends of the tine means, being inserted into the ground from opposite direction toward each other, encompass a mass of ground between them to securely anchor the stake device in the ground. Removal of the device from the ground is by first lifting the arcuate tine means from the ground and then lifting the angular spike means from the ground.

16 Claims, 12 Drawing Figures

GROUND ANCHOR STAKE DEVICE

It has long been known that when a stake for tethering animals, anchoring tents, etc., is driven vertically into the ground, the desired results are not always satisfactory. In order to obtain sufficient holding strength, such stakes must be driven into the ground relatively deep. Not only is considerable bother and force required to drive such stakes into the ground, but they are quite difficult to subsequently remove from the ground.

One of the methods for improving the holding qualities of such stakes has been to place fin-like members on the ground-penetrating portion of them. The fins do improve the holding qualities, but they make them more difficult to remove from the ground.

It has also been well known that by driving an ordinary stake into the ground at an angle to the ground surface, the holding qualities in a direction opposite that of the angle are improved. The technique is widely utilized in anchoring tents where the pull is primarily in one direction only.

There still remains, however, a need for improved, cheaper and easily manufactured ground anchor, which is easy to put into the ground and easy to take out of the ground.

The following patents were noted in a preliminary novelty search:

- U.S. Pat. No. 344,683 issued June 29, 1886 to S. B. Sherer;
- U.S. Pat. No. 425,385 issued Apr. 8, 1890 to W. W. McKay;
- U.S. Pat. No. 3,485,137 issued Dec. 25, 1969 to R. P. Clements;
- U.S. Pat. No. 824,182 issued June 26, 1906 to F. Knoff;
- U.S. Pat. No. 2,812,743 issued Nov. 12, 1957 to E. G. Dustin;
- U.S. Pat. No. 2,156,021 issued Apr. 25, 1939 to J. A. Little;
- U.S. Pat. No. 4,144,843 issued Mar. 20, 1979 to Benton Schrougham; and
- U.S. Pat. No. 3,305,984 issued Feb. 28, 1967 to Michael W. Borcuk.

It is noted that none of these patents disclose all the elements of the invention herein, or suggest in any obvious manner the combination of those elements of the invention as claimed herein. Of these prior art devices, it is submitted that the less remote of these patents appear to be U.S. Pat. No. 3,305,984, U.S. Pat. No. 2,156,021, and U.S. Pat. No. 4,144,843.

U.S. Pat. No. 3,305,984 discloses an ice anchor device comprising a single element consisting of an elongated arm with a hook at one end and in the opposite direction connected at an acute angle to an ice penetrating shank. When the shank portion is driven or pushed into the ice at the correct acute angle the elongated arm will lie horizontally on the surface of the ice. Thus when a rope or guy line is placed in the hook on the elongated arm, it can serve to anchor an object in the direction of the angle formed between the arm and shank portions. It would not serve as a satisfactory anchor in the opposite direction.

U.S. Pat. No. 2,156,021 discloses a two-piece stake arrangement. One piece comprises a spiral or corkscrew shank member adapted to be screwed vertically into the ground by means of a shank extending angularly upward from the ground surface. The second piece comprises an elongated arm member with a hook on one end adapted to be hooked into an eye on the spiral shank member at its upper end and above the ground after said spiral shank member has been screwed into the ground. The other end of the elongated arm has a ground-penetrating slightly curved shank portion.

To use the Little device, the spiral stake member, separated from the arm shank member, is held vertically to the ground surface, and screwed into the ground by pushing down while turning the shank. Thereafter, the elongated arm member is attached to the spiral stake by means of the hook on one end and the eye on the spiral shank member. The slightly curved shank portion near the opposite end of the elongated arm is then pushed into the ground.

U.S. Pat. No. 4,144,843 discloses a ground anchor device having a baseplate with a vertical shaft attached thereto. The base plate also has a pair of arcuate tines rotatably attached through elongated arms to opposite ends of the base plate.

To use, the vertical shank is pushed into the ground until the base plate rests firmly on the ground. One of the arcuate tines is next pushed into the ground remote from the point of rotable attachment of the elongated arm to the base plate. Finally the second arcuate tine is similarly inserted to lock the stake in the ground. Schrougham has previously described a ground anchor comprising a base plate with a vertical shank and a single arcuate tine rotatably attached through an elongated arm to the base plate.

The above prior art discloses an angular shank ground anchor used alone and a vertical shank in combination with an arcuate tine member. Thus, while some elements employed in the present invention are disclosed, they are employed in a quite different manner than that taught by this application.

There is no showing of function or cooperation with the other elements in a similar manner as disclosed in the present invention. Accordingly, it is believed that there is no showing or suggestion of the unique combination as taught by applicants in the present invention.

SUMMARY OF THE PRESENT INVENTION

The ground anchor of a first embodiment of the present invention comprises a device having two movably interconnected body members. The first body member has a first arm and a spike or shank rigidly interconnected to provide an acute angle therebetween. The second body member has a second arm and a curved tine which are rigidly interconnected.

The first and second body members are formed into a unit of movably interconnecting the second arm of the second body member to the first body member adjacent the interconnection of the first arm and the spike.

The movable interconnection permits the free end of the tine to be free for pushing into the ground, even though the spike or shank has been pushed into the ground.

The tine means is of circular arcuate form, having its radius of curvature generally coincident with the axis of the interconnecting means by which the second body member is connected to the first body member; and the first body member, on its arm, is provided with tether-attaching means on the upper surface thereof.

The anchor stake device is insertable in the ground by first pushing the spike means into the ground by pushing onto the first body member's arm held horizontally to the ground so that the spike enters the ground at an angle and until that arm rests horizontally on the ground surface, and second, pushing the tine means into the ground by pushing on the second arm until the second arm comes into alignment with the said first arm means.

To remove the stake, the tine is removed by pulling up on the second member arm, and then removing the shank by pulling up on the first member arm.

OBJECTS OF THE PRESENT INVENTION

It is an object of the present invention to provide a novel ground anchor stake device which may be used for a wide variety of anchoring and tethering conditions, and which achieves advantages over other anchor devices.

It is another object of the present invention to provide a ground anchor of sturdy but convenient type, which permits the user to easily and quickly insert it into the ground and also to easily and quickly remove it from the ground.

It is a further object of the present invention to provide a sturdy ground anchor device which is very versatile and yet economical to manufacture.

Figure 7:
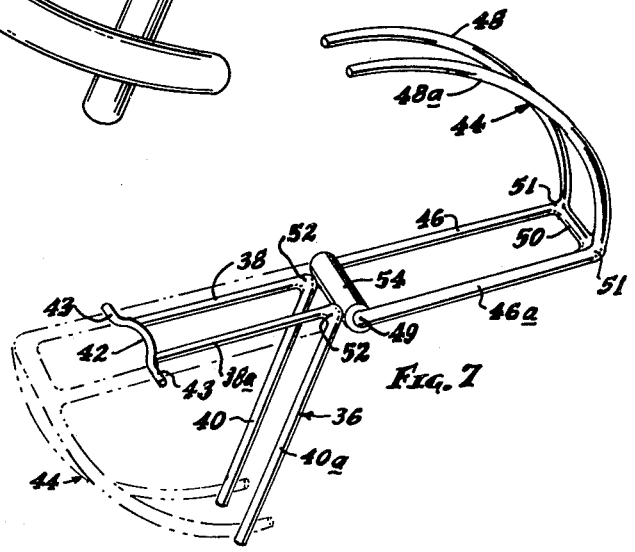
FIG. 7 is a perspective view, in smaller scale, showing the device of the embodiment of FIG. 6 in an open position, in full lines, and in closed position, in chain lines.
Figure 8:
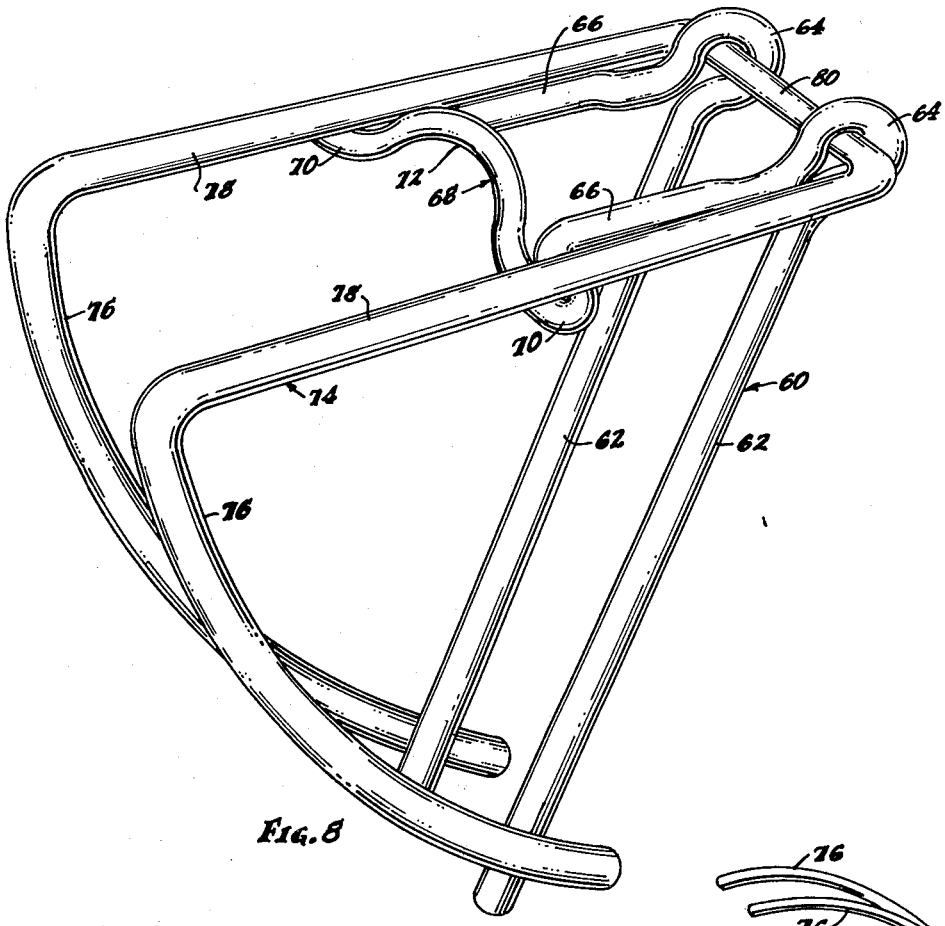
FIG. 8 is a perspective view, in larger scale, of a third embodiment, this having two parallel spike members and two parallel tine members, but each of those sets are formed from a unitary length of rod stock formed to provide the spikes and tines but also the interconnection means.
Figure 9:
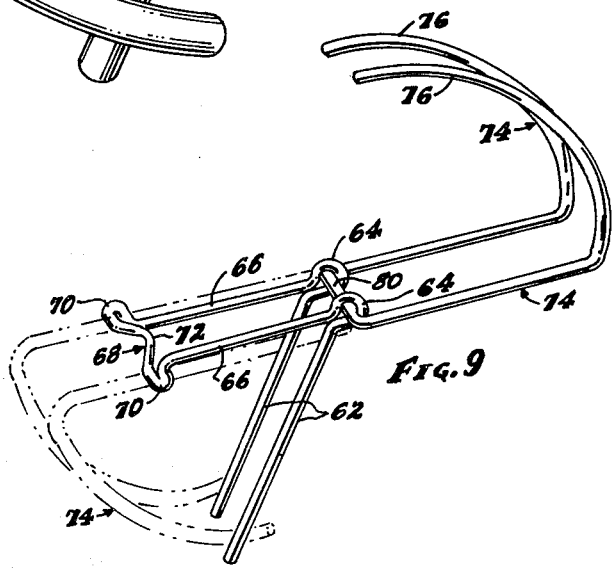
Figure 10:
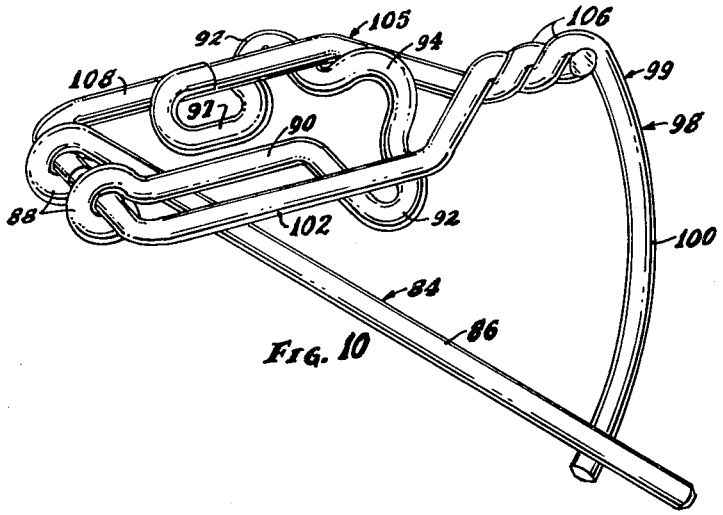
Figure 11:
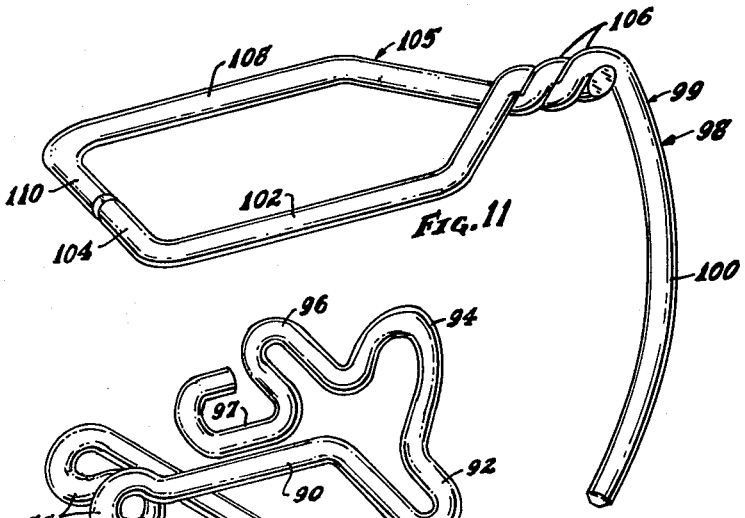
Figure 12:
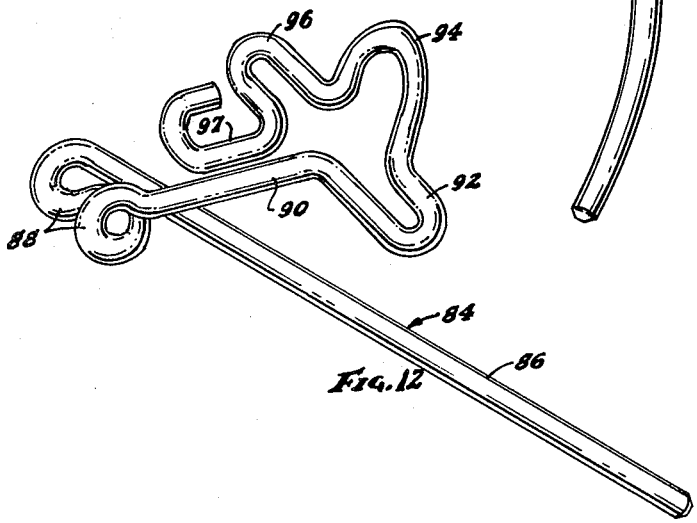

FIG. 9, in smaller scale, is a perspective view similar to FIG. 7, but of the embodiment shown in FIG. 8;

FIG. 10, in larger scale, is a pictorial view of still another embodiment, showing an assembly of the components shown in FIGS. 11 and 12;

FIG. 11 is a pictorial view of a tine member of the embodiment shown in FIG. 10; and FIG. 12 is a pictorial view of the spike member shown in FIG. 10.

DETAILED DESCRIPTION OF THE PRESENT INVENTION

One embodiment of a ground anchor stake device constructed in accordance with concepts of the present invention is shown in FIGS. 1 through 5; and it includes a first body member 20 and a second body member 22. The first body member 20 has a spike portion 24 and an elongated arm portion 26, joined at a junction 25. The elongated arm portion 26 has a tether-attaching member 28 positioned on the upper surface thereof and a lug 30 on its end which is opposite the junction 25.

The elongated arm portion 26 and the spike portion 24 are spaced apart at an acute angle, at their junction 25.

Adjacent the junction 25 between arm 26 and spike 24, and noted as being remote from the tethering means 28, a hinge member 31 shown as a bushing or tube joins the first body member 20 with the second body member 22. The second body member 22 has generally parallel elongated arm members 32 and **32*a*, and an arcuate tine 34 at its end 34*a*. The tine 34 is of circular arcuate form, having its radius of curvature generally coincident with the axis of connector 35 which interconnects the elongated arm members 32 and 32*a* at their end opposite the tine 34. The connector 35 is carried in the tube 31, at the end of arms 32 and 32*a*, removed from the tine portion 34, to permit the tine 34 to pivot about the axis of the hinge member 31**.

Figure 2:
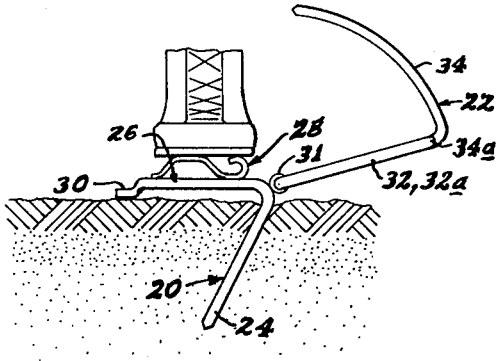
FIG. 2 is a pictorial representation of the anchor stake of FIG. 1, in a preliminary step of inserting into ground, this view showing only the stake component having been forced into the ground, at an acute angle to the ground surface.
Figure 3:
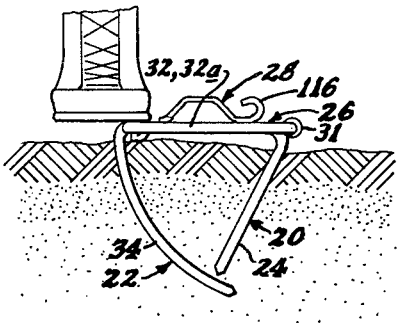
FIG. 3 is a pictorial representation similar to FIG. 2, but at the completed or ground-holding stage, with the curved tine member also having been forced into the ground.
Figure 1:
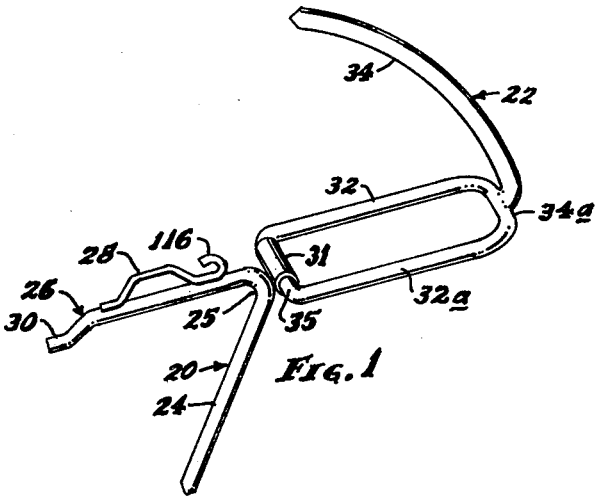
FIG. 1 is a perspective view of a ground anchor device constructed in accordance with the present invention, showing the device in open position prior to insertion in the ground.
Figure 4:
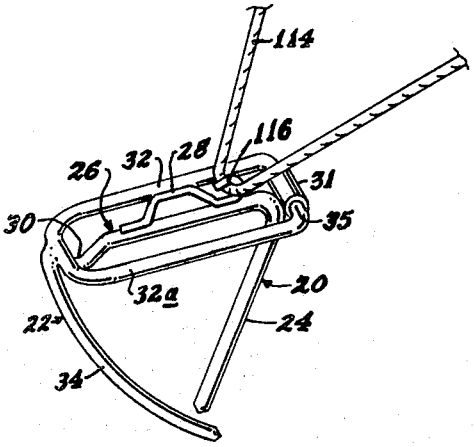
FIGS. 4 and 5 are perspective views showing the device of FIGS. 1 through 3 in a closed position as when inserted in the ground, and showing two different ways respectively of attaching tethering lines.
Figure 5:
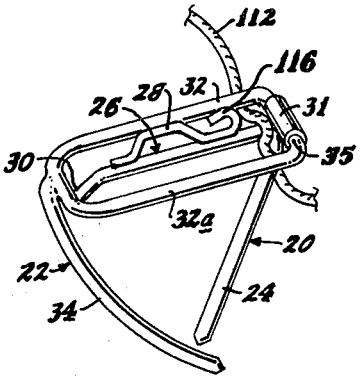

The anchor stake device shown in FIGS. 1 through 5 is utilized as follows: With the stake in an open position as shown in FIG,. 1, the arm portion 26 is grasped in the user's hand and held horizontal to the ground. The spike portion 24 is then pushed into the ground at an acute angle from the horizontal. After completely inserting the spike 24, the arm 26 should rest firmly on the horizontal surface of the ground. Next, the second body member 22 is pivoted about the hinge member 31, and the point of the tine 34 pushed into the ground through a semicircular path until the arm having members 32 and **32*a* is in alignment with arm 26 on the ground surface and a portion rests on the lug 30. Thus, when inserted in the ground, the stake is in the closed position as shown in FIGS. 3, 4, and 5**.

Figure 6:
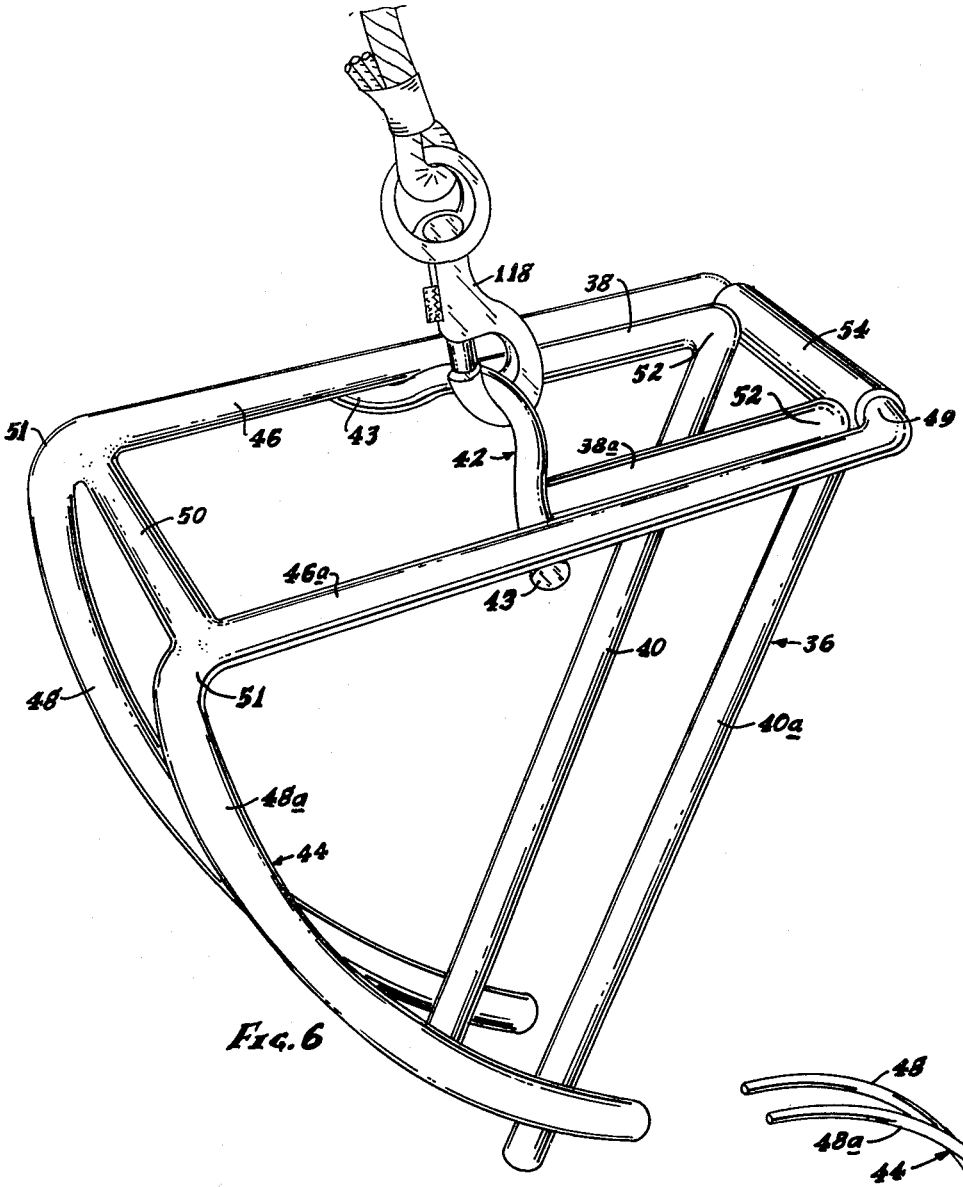
FIG. 6 is a perspective view, in larger scale, showing a ground anchor device in a closed position in a second embodiment which has two parallel spike members and two parallel tine members.

FIGS. 6 and 7 illustrate the embodiment of the invention wherein the first body member 36 has a generally parallel pair of arm members 38 and **38*a* and a pair of generally parallel spike members 40 and 40*a*. The ends of arm members 38 and 38*a* are joined by the upraised loop or leash-attaching means 42. The ends 43 of leash means 42** serve as lugs.

The pair of arms 38 and **38*a* are spaced apart at an acute angle from the pair of spikes 40 and 40*a***.

The second body member 44 has a generally parallel pair of arm members 46 and **46*a* and a pair of parallel arcuate tine membrers 48 and 48*a*. The tines 48 and 48*a* are of circular arcuate form, having their radii of curvature generally coincident with the axis of a connector 49 of the arm members 46 and 46*a* at their ends opposite the tines 48 and 48*a*. A crossbar 50 serves to hold the arms 46 and 46*a* in a spaced-apart position, adjacent the junction 51 of those arms 46–46*a* and the tines 48–48*a***.

Adjacent the junction 52 of arms 38 and **38*a* with the spikes 40 and 40*a*, a hinge member 54 shown as a tube of body member 36 carries the connector 49 and thus joins the first body member 36 with the second body member 44 at the end of arms 46 and 46*a* removed from the tine portions 48 and 48***a*, permitting the tines to pivot about the axis of the hinge member 54.

The device shown in FIGS. 6 and 7 is used by first pushing the pair of spikes 40 and 40*a* into the ground at an angle such that the pair of arms 38 and 38*a* come to rest horizontally on the ground surface. Second, the pair of tines 48 and 48*a* are pivoted about the hinge portion 54 axis and pushed into the ground until arms 46 and 46*a* are in alignment with arms 38 and 38*a* and in abutment with the lug ends 43 on the upwardly extending leash-holding means 42.

FIGS. 8 and 9 illustrate a third embodiment of the invention. As there shown, a unitary length of rod is formed to provide a first body member 60, the ends of which provide the spikes 62. Inwardly of the spikes 62, the rod is formed to provide loops 64; and inwardly of the loops the rod is formed horizontally forwardly into arms 66 interconnected by a crossing or lateral portion 68 which has outturned ears 70 joined by an upwardly-extending loop or leash means 72 similar to the loop 42 of FIGS. 6 and 7.

Correspondingly of unitary form, the embodiment of FIGS. 8 and 9 shows the second body member 74 formed of a single length of rod stock to provide a pair of curved tines 76, inwardly of which are arm members 78 inter-connected at their ends opposite the tines 76 by a transverse connector 80.

The pivotal hinge of this embodiment is the carry of the connector 80 by the loops 64; and this embodiment advantageously achieves all the components without need of any welding or other metal-securing procedures, and without extra parts such as the attachment member 28 and tube 31 of FIGS. 1 through 5, or 42 and 54 of FIGS. 6 and 7.

Other than that important advantage, the embodiment of FIGS. 8 and 9 is like that of FIGS. 6 and 7 in construction and use.

FIGS. 10–12 illustrate still another embodiment. The first body member 84, from a single length of rod (FIG. 12), provides a spike 86, two laterally-spaced loops 88, an arm 90, and outturned ear 92, an upwardly-extending loop 94, an oppositely-directed outturned ear 96, and an arm 97 parallel to arm 90.

The second body member 98, of FIG. 11, from a first length 99 of rod stock provides a tine 100, and an arm 102 having an inwardly-directed end 104; and a second length of rod 105 is twisted as at 106 onto the first length, between its tine 100 and its arm 102, and comprises an arm 108 parallel to the arm 102, and an inturned end 110 which is directed toward and is co-axial with the end 104. The ends 104 and 110 co-operate to provide a hinge pin, carried in the loops 88, movably interconnecting the two body members 84 and 98.

The non-connected nature of the ends 104 and 110 permits the arms 102 and 108 to be resiliently sprung apart in use; for with a rope or line laid over the arms 90 and 97, and then the second body member 98 being swung downwardly into ground-engaging position (as in FIG. 3), the rope or line will be clampingly held or gripped between that set of arms 90 and 97 and the arms 102 and 108.

All the embodiments are similar, in providing the movably-related body members, an acute angle relation of the spike and the arm of the first body member, and some sort of tethering member on the arm of the first body member; and all embodiments are useful.

The tether attaching means 28 is extremely versatile, and makes the stake useful in dog training techniques.

In FIG. 5 a leash or rope 112 lead is draped over the arm 26 near the hinge 31 after spike 24 has been inserted in the ground. When the tine member 34 is next inserted in the ground, the leash 112 is clamped and securely held as shown in FIG. 5. This manner of leash attachment does not require that the leash have a snap on it or that it be tied. When a bird dog is on point, the trainer can walk in behind the dog, place the stake device in the ground, and clamp a rope leading from the dog's collar. The trainer now goes out in front of the dog to flush the game bird being pointed. The rope clamped to the stake device prevents the dog from chasing the bird.

FIG. 4 illustrates a controlled releasable tethering technique wherein the stake device is put into the ground behind a dog on point or a dog being taught to "whoa" or "stay." One end of a rope check cord 114 is attached to the dog's collar, the trainer loops the rope around the hook 116 on the tethering means 28 while holding on to the other end of the check cord. The trainer can move out in front of the dog and prevent the dog from moving forward until he is ready. When the trainer is ready he can release the dog by releasing his hold on the check cord.

FIG. 6 illustrates a type of tethering means wherein a snap or other fastening means 118 on one of a rope or the like is fastened to the upraised member 42 on the tethering means and the other end of the rope is fastened to the dog's collar.

In addition to use as a snubbing stake device in training animals as described above, the device described in the several embodiments of FIGS. 1–5 and 10–12 all have outstanding utility for anchoring tents, badminton nets, volley ball nets, and the like where the pull on the stake remains primarily in one direction only. Since the tethering means on the stake device lies close to the surface of the ground, the stake can be mowed over (usually), and there is less danger of a person tripping over it.

Most ground conditions where you camp, put up game nets, and train dogs, will allow you to put the stake device into the ground by use of your hands and feet only. This is complied with by stake devices manufactured using $\frac{3}{8}''$ rod material wherein the spike member is at an acute angle and penetrates the ground to a depth of about 6 or 7 inches, and the curved tine member follows a circular path of a circle having a diameter of 6 or 7 inches allowing the tip to penetrate the ground to a depth of 6 or 7 inches. In special cases smaller or larger rod material may be used. The larger sizes, using heavier rod material and longer spike and tine means, may require that the spike and tine means be driven into the ground with a mallet or sledge hammer. Such larger sizes may be required when used as anchor for fence-posts. These larger sizes may also be used for anchoring small aircraft.

The devices described in FIGS. 6–9, wherein there are a pair of parallel spikes and a pair of parallel tines, are most useful for those anchoring operation where there is more than one direction of pull, or a continual changing of the direction of pull. One such operation is the tethering of animals. One size may be used for dogs, goats, sheep, or other small animals, whereas a larger size may be required for larger animals such as horses or cattle.

While we prefer to utilize metal rod material in the manufacture of our stake device, we may use instead thereof elongated strap material. We may, for example, utilize strap material that is 1" wide and 2/16" thick.

Stake devices thus manufactured are useful for anchoring boats, buoys, temporary docks, etc., wherein ground conditions encountered may comprise softy sandy shores, soft muddy shores, and marshy areas.

In view of the foregoing description, it should be readily apparent that the present invention provides a novel, improved ground anchor device which is of relatively simple construction, is very easy to use, and has a greater versatility than prior art ground anchor devices.

What is claimed is:

1. An anchor stake device, comprising a movably interconnected first body member means and a second body member means;

the first body member means having a first arm means and a spike means, the said first arm means and the said spike means being regidly interconnected to one another in a relative position such that they are maintained at an angle with respect to one another;

and the second body member means having a second arm means and a tine means, the said second arm means and the said tine means being rigidly interconnected;

the said tine means being connected to the second arm means adjacent a first end of the said second arm means;

means movably interconnecting the first and second body members by movably interconnecting the second end of the second arm means of the second body member means to the first body member means adjacent the interconnection of the first arm means means and the spike means but remote from the tethering means set forth below;

tethering means by which an associated support member is to be supportingly connected to the anchor stake device;

the ends of both the spike means and the tine means being free for pushing into the ground, on the ends thereof remote from the first arm means and the second arm means, respectively;

the tine means being of curcular arcuate form having its radius of curvature generally coincident with the axis of the said movably interconnecting means;

the anchor stake device being insertable in the ground by pushing the said spike means into the ground by pushing onto the said first arm means, then pushing the said tine means into the ground by pushing on the said second arm means until the said second arm means comes into substantial ground-engaging parallelism with the said first arm means.

2. In a ground anchor device, the combination of a first body member means having a first arm means adapted to lie horizontally on the ground surface and a spike means affixed thereto and adapted to penetrate the ground at an acute angle between the spike means and the ground surface upon which the first arm means lies;

the said first arm means having tethering means thereon;

a second body member means having a second arm means adapted to lie horizontally on the surface of the ground and an arcuate tine means adapted to penetrate the ground in an arc;

wherein the second arm means end opposite the tine portion is movably attached to said first body member means adjacent the upper end of the first body member means spike means but remote from the tethering means;

the free ends of both the spike means and the tine means being movable toward each other in a vertical plane permitting insertion into the ground from opposite directions;

the said tine means being of curcular arcuate form having its radius of curvature generally coincident with the axis by which the said movable second arm means is movably connected to the first body member means as aforesaid;

the anchor device being operable by first inserting the said spike means into the ground at an acute angle with respect to ground surface, by pushing on the first body member means until said first arm means rests horizontally on the ground surface, and secondly inserting the arcuate tine means into the ground by pushing on the second arm means until said second arm means rests horizontally with respect to the ground surface and in substantial ground-engaging parallelism with the first arm means.

3. The invention as set forth in either of the preceding claims in a combination in which the said spike means of the said first body member means comprises a parallel pair of spike members formed as aforesaid, providing greater stability and anchoring of the ground-security operativity of the anchor stake device when a tensile force is imparted to the tethering means from various directions.

4. The invention as set forth in either of claims 1 or 2, in a combination in which the said tine means of the said second body member means comprises a parallel pair of tine members formed as aforesaid, providing greater stability and anchoring of the ground-security operativity of the anchor stake device when a tensile force is imparted to the tethering means from various directions.

5. The invention as set forth in either of claims 1 or 2, in a combination in which the said second arm means comprises a spaced pair of rod members.

6. The invention as set forth in either of claims 1 or 2, in a combination in which the said tethering means is provided for the said first arm means the said tethering means operatively extending accessibly upwardly of the said second arm means when the said tine means of the second body member means is pushed into the ground an amount such that the first body member means and the second body member means come into abutment by abutment of the said first arm means and the said second arm means; and the subsequent attachment of an associated support member to the said tethering means thereby operatively also locks the said first body member means and the said second body member means in ground-engaging position by preventing upward movement of the said second arm means and thus also preventing upward or ground-disengaging movement of the said second body member means.

7. The invention as set forth in claim 6 in which the said tethering means of the said first arm means is of a position and upwardly extending nature such that for an attachment thereto, of the said associated support member, the said associated support member operatively abuttingly overlies a portion of the said second arm means and thereby serves to automatically provide the said operative locking of the said first body member means and the said second body member means in ground-engaging position.

8. The invention as set forth in claim 6 in a combination in which the said first arm means comprises a pair of spaced members whose end portions remote from the said movably interconnecting means are rigidly joined by a transverse member, the central portion of which provides the said tethering means.

9. The invention as set forth in claim 6 in a combination in which the said first arm means is provided with a transverse support member which both provides the said tethering means by its central portion, and also its end portions provide the abutment means abuttingly engageable by the said second arm means of the said second body member means.

10. The invention as set forth in any of claims 1 or 2 in a combination in which the said second arm means is provided with an operatively open central portion, the side walls of the said central portion being such that when the said first arm means and the said second arm means are in abutment the said side walls of the said second arm means are spaced from the respective outer side portions of the said first arm means an amount sufficient to snugly receive an associated support member to releasably retain the same when the said first body member means and the said second body member means are in abutment relationship, but which releases the said associated support member when the abutment relationship is terminated.

11. The invention as set forth in any of claims 1 or 2 in a combination in which the said second arm means of the said second body member means includes a rod member having a transversely-extending portion which provides the portion thereof which is movably interconnected to the said first body member means, and extending therefrom the rod member is formed to provide spaced and generally parallel portions interconnected at the end thereof remote from the said transversely-extending portion, thereby providing the said second arm means.

12. The invention as set forth in any of claims 1 or 2 in a combination in which the said second body member means comprises a unitary strip of rod material whose ends respectively provide the tine means, and the intermediate portions provide the second arm means, and the central portion provides a transversely-extending portion which comprises the portion of the said second body member means which is movably interconnected to the said first body member means.

13. The invention as set forth in any of claims 1 or 2, in a combination in which the movably interconnecting means is provided by forming one of the first body member means and the second body member means to integrally provide a loop means which operatively hingedly encircles a portion of the other.

14. The invention as set forth in claim 13, in a combination in which the body member means having the said loop means is the first body member means, and the said first body member means forwardly of the said loop means is formed of stock integral with said loop means and which remote therefrom is integrally formed to provide both the said tethering means and abutment means abuttingly engageable by the second arm means of the second body member means when the latter is forced fully into the ground.

15. The invention as set forth in any of claims 1 or 2, in a combination in which the said second arms means of the said second body member means is provided to provide a pair of inturned fingers which co-operate to provide a component of the said movable interconnecting means, and the said second arm means also provides resiliently deformable means which provides that the said fingers are resiliently movably related, permitting a resilient withdrawal of opposed portions of the second arm means to accommodate a snug but releasable gripping of an associated tethering line between adjacent portions of the first arm means and the second arm means, the said gripping being automatically achieved by merely the pushing of the second body member means fully into ground-engaging position after the associated tethering line has been laid over the first arm means in a region thereof which is adjacent the second arm means when the second arm means is in the location it is when the second body member has been pushed fully into its ground-engaging position.

16. The invention as set forth in any of claims 1 or 2, in a combination in which the said second arm means is provided as a pair of parallel rod members interconnected at their aforesaid first end by operatively twisting them together.

* * * * *

UNITED STATES PATENT AND TRADEMARK OFFICE

CERTIFICATE OF CORRECTION

PATENT NO. : 4,315,387

DATED : February 16, 1982

INVENTOR(S) : John W. Lee and Benton Schrougham

It is certified that error appears in the above—identified patent and that said Letters Patent is hereby corrected as shown below:

Col. 7, line 17: The word "regidly" should be --rigidly--.

Col. 7, line 32: The first word "means" should be taken out.

Col. 7, line 42: The word "curcular" should be --circular--.

Col. 8, line 5: The word "curcular" should be --circular--.

Signed and Sealed this

*Thirty-first* Day of *August 1982*

[SEAL]

*Attest:*

GERALD J. MOSSINGHOFF

*Attesting Officer*

*Commissioner of Patents and Trademarks*